US009836016B2

(12) United States Patent
Kawakami et al.

(10) Patent No.: US 9,836,016 B2
(45) Date of Patent: Dec. 5, 2017

(54) IMAGE FORMING APPARATUS AND CARTRIDGE

(71) Applicant: CANON KABUSHIKI KAISHA, Tokyo (JP)

(72) Inventors: Takuya Kawakami, Mishima (JP); Kazuo Chadani, Suntou-gun (JP); Go Torii, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/190,312

(22) Filed: Jun. 23, 2016

(65) Prior Publication Data

US 2017/0003645 A1 Jan. 5, 2017

(30) Foreign Application Priority Data

Jul. 1, 2015 (JP) ..... 2015-132988

(51) Int. Cl.
*G03G 15/00* (2006.01)
*G03G 21/16* (2006.01)
*G03G 21/18* (2006.01)

(52) U.S. Cl.
CPC ..... *G03G 21/1652* (2013.01); *G03G 21/1871* (2013.01); *G03G 21/185* (2013.01)

(58) Field of Classification Search
USPC ..... 399/75, 88–90, 107, 110, 111
See application file for complete search history.

(56) References Cited

U.S. PATENT DOCUMENTS

| | | | |
|---|---|---|---|
| 5,943,529 | A | 8/1999 | Miyabe et al. |
| 5,966,567 | A | 10/1999 | Matsuzaki et al. |
| 6,144,815 | A | 11/2000 | Chadani et al. |
| 6,173,140 | B1 | 1/2001 | Suzuki et al. |
| 6,173,145 | B1 | 1/2001 | Chadani et al. |
| 6,178,302 | B1 | 1/2001 | Nagashima et al. |
| 6,205,305 | B1 | 3/2001 | Suzuki et al. |
| 6,219,504 | B1 | 4/2001 | Matsuzaki et al. |
| 6,282,389 | B1 | 8/2001 | Matsuzaki et al. |
| 6,301,457 | B1 | 10/2001 | Chadani et al. |
| 6,473,585 | B2 | 10/2002 | Abe et al. |
| 6,512,903 | B2 | 1/2003 | Chadani |
| 6,535,699 | B1 | 3/2003 | Abe et al. |

(Continued)

FOREIGN PATENT DOCUMENTS

| | | |
|---|---|---|
| JP | 2005-128469 A | 5/2005 |
| JP | 2005-258344 A | 9/2005 |

(Continued)

*Primary Examiner* — Hoan Tran
(74) *Attorney, Agent, or Firm* — Fitzpatrick, Cella, Harper & Scinto

(57) ABSTRACT

An apparatus body includes an elastic body-side terminal, which is a terminal for supplying electricity to a cartridge. The cartridge includes: a developing apparatus that develops as a developer image an electrostatic latent image formed on an image bearing member; a cartridge-side terminal for supplying electricity from the apparatus body; and a frame having an opening that exposes the cartridge-side terminal. In a process of attaching the cartridge to the apparatus body, the body-side terminal makes contact with the cartridge-side terminal by being inserted into the opening. The body-side terminal presses the cartridge-side terminal in a state in which the cartridge is attached to the apparatus body.

15 Claims, 9 Drawing Sheets

(56) References Cited

U.S. PATENT DOCUMENTS

| | | | | |
|---|---|---|---|---|
| 6,671,474 | B2 | 12/2003 | Chadani | |
| 6,795,666 | B2 | 9/2004 | Miyabe et al. | |
| 6,823,155 | B2 | 11/2004 | Tsuda et al. | |
| 6,931,226 | B2 | 8/2005 | Chadani et al. | |
| 6,934,485 | B2 | 8/2005 | Miyabe et al. | |
| 6,980,759 | B2 | 12/2005 | Kanno et al. | |
| 7,136,604 | B2 | 11/2006 | Chadani et al. | |
| 7,184,682 | B2 | 2/2007 | Chadani et al. | |
| 7,433,622 | B2 | 10/2008 | Chadani et al. | |
| 7,499,663 | B2 | 3/2009 | Sato et al. | |
| 7,570,900 | B2 | 8/2009 | Chadani et al. | |
| 7,689,146 | B2 | 3/2010 | Sato et al. | |
| 7,840,154 | B2 * | 11/2010 | Ishii | G03G 15/55 399/90 |
| 7,890,025 | B2 | 2/2011 | Chadani et al. | |
| 7,899,364 | B2 | 3/2011 | Chadani et al. | |
| 8,116,661 | B2 | 2/2012 | Chadani et al. | |
| 8,160,478 | B2 | 4/2012 | Munetsugu et al. | |
| 8,165,493 | B2 | 4/2012 | Chadani et al. | |
| 8,306,460 | B2 | 11/2012 | Chadani et al. | |
| 8,335,454 | B2 | 12/2012 | Chadani et al. | |
| 8,401,424 | B2 | 3/2013 | Suzuki et al. | |
| 8,442,416 | B2 | 5/2013 | Chadani et al. | |
| 8,447,209 | B2 | 5/2013 | Chadani et al. | |
| 8,503,906 | B2 | 8/2013 | Suzuki et al. | |
| 8,559,849 | B2 | 10/2013 | Suzuki et al. | |
| 8,583,007 | B2 | 11/2013 | Chadani et al. | |
| 8,588,647 | B2 | 11/2013 | Chadani et al. | |
| 8,639,160 | B2 | 1/2014 | Chadani et al. | |
| 8,682,200 | B2 | 3/2014 | Chadani et al. | |
| 9,058,018 | B2 | 6/2015 | Chadani et al. | |
| 9,116,503 | B2 | 8/2015 | Fukasawa et al. | |
| 9,134,688 | B2 | 9/2015 | Chadani et al. | |
| 9,395,679 | B2 | 7/2016 | Kawakami et al. | |
| 2005/0069338 | A1 | 3/2005 | Oguma et al. | |
| 2005/0201772 | A1 | 9/2005 | Ishii et al. | |
| 2006/0008289 | A1 | 1/2006 | Sato et al. | |
| 2013/0223853 | A1 | 8/2013 | Chadani et al. | |
| 2015/0362891 | A1 | 12/2015 | Chadani et al. | |

FOREIGN PATENT DOCUMENTS

| | | | |
|---|---|---|---|
| JP | 2011-203315 | A | 10/2011 |
| JP | 2012-226289 | A | 11/2012 |

* cited by examiner

IMAGE FORMING APPARATUS AND CARTRIDGE

BACKGROUND OF THE INVENTION

Field of the Invention

The present invention relates to an image forming apparatus which uses an electrophotographic technique and a cartridge capable of being detachably attached to the image forming apparatus.

Description of the Related Art

In an image forming operation of an image forming apparatus which uses an electrophotographic technique, first, a photosensitive drum is uniformly charged by a charging roller. Moreover, the charged photosensitive drum is selectively exposed by an exposure device, whereby an electrostatic latent image is formed on the photosensitive drum. The electrostatic latent image formed on the photosensitive drum is developed by a developing apparatus as a toner image.

Moreover, the toner image formed on the photosensitive drum is transferred to a sheet by a transfer roller. The toner image transferred to the sheet is pressurized and heated by a fixing device whereby the toner image is fixed to the sheet. The image forming apparatus forms an image on the sheet in this manner.

In the image forming apparatus, in general, replenishment of toner and maintenance of means for forming an image on the sheet (process means) or the like are required.

In recent years, in order to perform such maintenance and the like easily, the photosensitive drum, the charging roller, the developing apparatus, and the like are integrated as a cartridge. A cartridge in which the photosensitive drum and the like are integrated is called a process cartridge and is detachably attached to an image forming apparatus body.

In such a cartridge, electrical terminals (cartridge-side terminals) for supplying voltage to process means such as the charging roller are provided. In a state in which the cartridge is attached to the image forming apparatus body, the cartridge-side terminals are electrically connected to electrical terminals (body-side terminals) provided on the image forming apparatus body. Here, when a foreign material adheres to the cartridge-side terminal, an electrical connection state between the cartridge and the image forming apparatus body may become unstable.

Thus, a configuration in which a shutter for covering the cartridge-side terminals is provided in a cartridge is proposed (Japanese Patent Application Publication No. 2005-128469). In a state in which the cartridge is detached from an image forming apparatus body, the shutter covers the cartridge-side terminals. Moreover, the shutter rotates in synchronization with an operation of attaching the cartridge to the image forming apparatus body whereby the shutter exposes the cartridge-side terminals.

However, in this configuration, since it is necessary to provide a mechanism for rotating the shutter in the cartridge, the number of components that form the cartridge increases. In addition, the increase in the number of components increases the cost of manufacturing the cartridge.

SUMMARY OF THE INVENTION

An object of the present invention is to provide an image forming apparatus comprising an apparatus body and a cartridge capable of being detachably attached to the apparatus body, wherein the apparatus body includes an elastic body-side terminal, which is a terminal for supplying electricity to the cartridge, the cartridge includes:

a developing apparatus that develops as a developer image an electrostatic latent image formed on an image bearing member;

a cartridge-side terminal for supplying electricity from the apparatus body; and a frame having an opening that exposes the cartridge-side terminal, in a process of attaching the cartridge to the apparatus body, the body-side terminal makes contact with the cartridge-side terminal by being inserted into the opening, and the body-side terminal presses the cartridge-side terminal in a state in which the cartridge is attached to the apparatus body.

Another object of the present invention is to provide a cartridge capable of being detachably attached to an apparatus body of an image forming apparatus, comprising:

a developing apparatus that develops as a developer image an electrostatic latent image formed on an image bearing member;

a cartridge-side terminal, which is a terminal for supplying electricity from the apparatus body to the cartridge; and a frame having an opening that exposes the cartridge-side terminal and into which a terminal provided on the apparatus body is inserted when the cartridge is attached to the apparatus body.

Further features of the present invention will become apparent from the following description of exemplary embodiments (with reference to the attached drawings).

DESCRIPTION OF THE EMBODIMENTS

Hereinafter, exemplary embodiments of the present invention will be described with reference to the accompanying drawings. However, dimensions, materials, shapes, relative positions, and the like of constituent components described in the embodiment are changed appropriately according to, for example, a configuration and various conditions of an apparatus to which the present invention is applied. That is, the scope of the present invention is not limited to the following embodiments.

First Embodiment

<Overall Configuration of Image Forming Apparatus>

Figure 1:
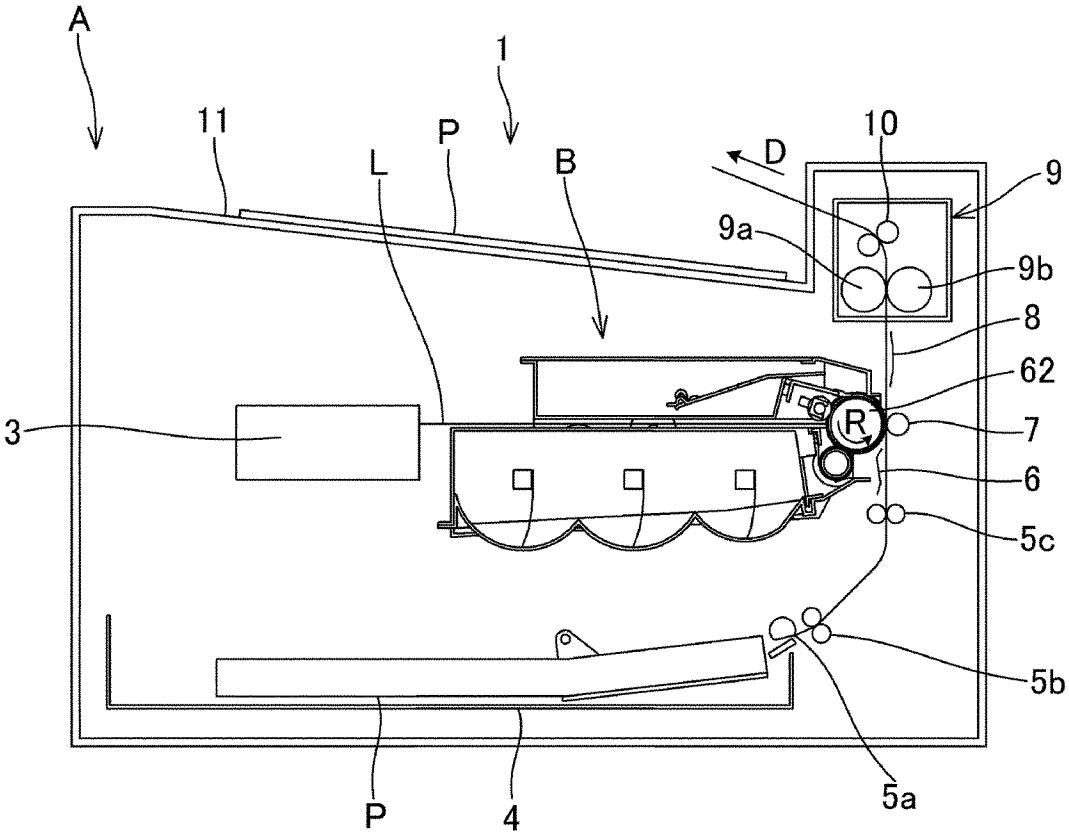
FIG. 1 is a schematic cross-sectional view of an image forming apparatus according to a first embodiment.

A first embodiment will be described. FIG. 1 is a schematic cross-sectional view of an image forming apparatus 1 according to the first embodiment. Here, an axial direction of the center of rotation of a photosensitive drum 62 (an image bearing member) is defined as a longitudinal direction. In this longitudinal direction, a side on which the photosensitive drum 62 receives the driving force from an apparatus body A of the image forming apparatus 1 is defined as a driving side, and the opposite side of the driving side is defined as a non-driving side. Here, the apparatus body A of the image forming apparatus 1 is a portion of the image forming apparatus 1 excluding a cartridge B (a process cartridge). The image forming apparatus 1 is a laser beam printer which uses an electrophotographic technique. In the image forming apparatus 1, the cartridge B is configured to be detachably attached to the apparatus body A. Moreover, a sheet tray 4 that stores a recording medium (hereinafter referred to as a sheet material P) on which an image is formed is disposed on a lower side of the cartridge B.

In the apparatus body A of the image forming apparatus 1, a pickup roller 5*a*, a feed roller pair 5*b*, a conveying roller pair 5*c*, a transfer guide 6, a transfer roller 7, a conveying guide 8, a fixing device 9, a discharge roller pair 10, and a discharge tray 11 are sequentially disposed in a conveying direction D of the sheet material P. The fixing device 9 includes a heating roller 9*a* and a pressure roller 9*b*.

<Image Forming Process>

Next, an image forming process will be described. First, when the image forming apparatus 1 receives a print start signal, the photosensitive drum 62 is driven to rotate in the direction indicated by arrow R in FIG. 1. A charging roller 66 (a charging member) (see FIG. 2) to which a bias voltage is applied uniformly charges an outer circumferential surface of the photosensitive drum 62 by making contact with the outer circumferential surface of the photosensitive drum 62. An exposure device 3 outputs a laser beam L to the photosensitive drum 62 according to image information. The laser beam L passes through a gap between a developing container 23 and a cleaning frame 71 of the cartridge B and scans and exposes the outer circumferential surface of the photosensitive drum 62. In this way, an electrostatic latent image corresponding to the image information is formed on the outer circumferential surface of the photosensitive drum 62.

Figure 2:
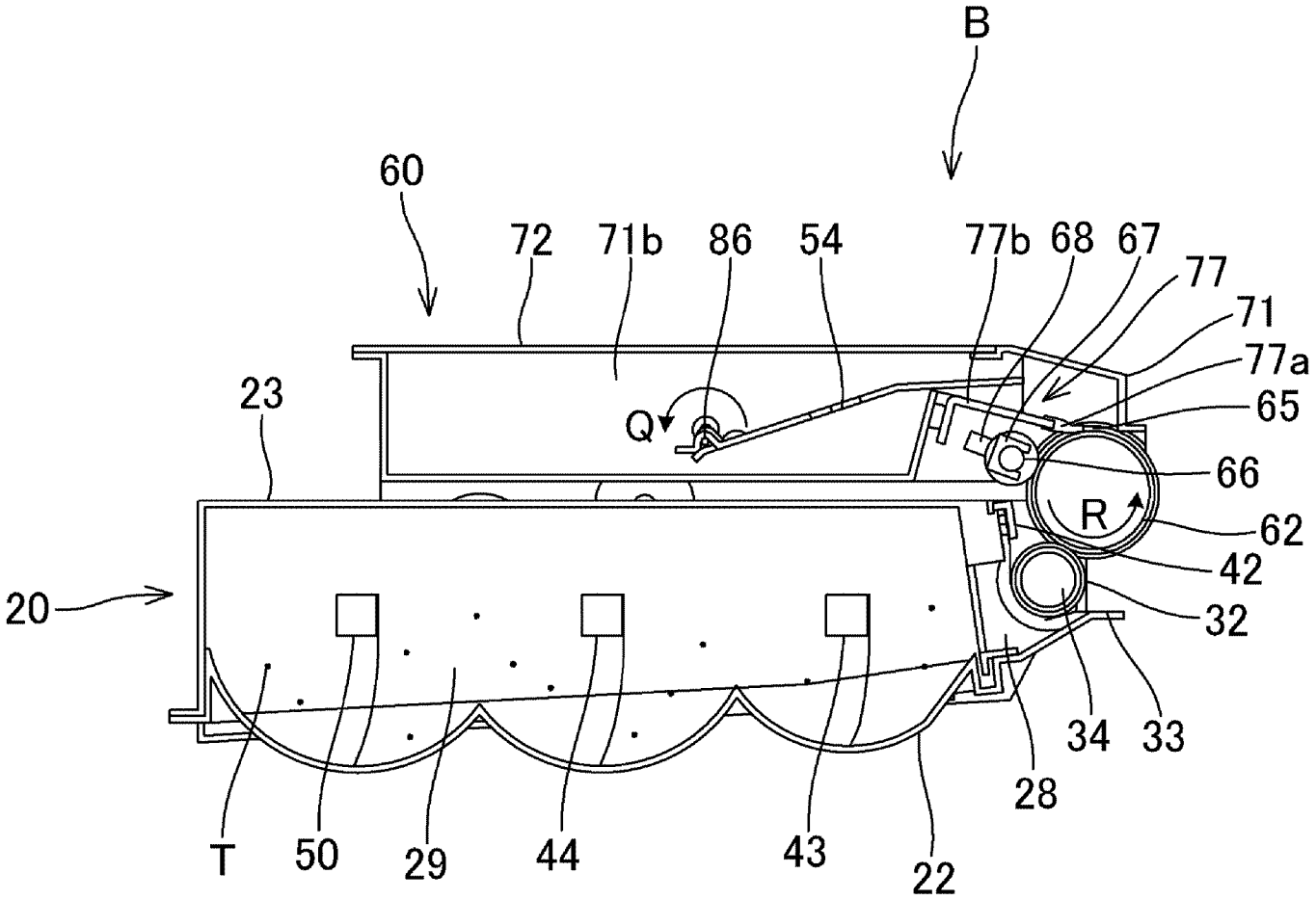
FIG. 2 is a schematic cross-sectional view of a process cartridge according to the first embodiment.

On the other hand, as illustrated in FIG. 2, in a developing unit 20 (a developing apparatus), toner T in a toner chamber 29 is delivered to a toner supply chamber 28 by being stirred and conveyed when a first conveying member 43, a second conveying member 44, and a third conveying member 50 rotate. The toner T delivered to the toner supply chamber 28 is borne on a surface of a developing roller 32 (a developer bearing member) by the magnetic force of a magnet roller 34 (a fixed magnet). The toner T borne on the developing roller 32 is triboelectrically charged by the developing blade 42 and the thickness of the toner T borne on the developing roller 32 is regulated to a constant thickness. The toner T borne on the developing roller 32 is supplied to the photosensitive drum 62, whereby the electrostatic latent image formed on the photosensitive drum 62 is developed as a toner image (a developer image).

Moreover, as illustrated in FIG. 1, the sheet material P stored in a lower portion of the apparatus body A is fed from the sheet tray 4 by the pickup roller 5*a*, the feed roller pair 5*b*, and the conveying roller pair 5*c* in synchronization with the timing at which the laser beam L is output. Moreover, the sheet material P is guided to the transfer guide 6 and is conveyed to a transfer position which is a nip portion between the photosensitive drum 62 and the transfer roller 7. At this transfer position, the toner image is transferred from the photosensitive drum 62 to the sheet material P.

The sheet material P to which the toner image is transferred is guided to the conveying guide 8 and is conveyed to the fixing device 9. Moreover, the sheet material P passes through the nip portion between the heating roller 9*a* and the pressure roller 9*b* of the fixing device 9. At this nip portion, the sheet material P is pressurized and heated whereby the toner image is fixed to the sheet material P. The sheet material P to which the toner image is fixed is discharged to the discharge tray 11 by the discharge roller pair 10. On the other hand, as illustrated in FIG. 2, the toner remaining on the photosensitive drum 62 after the toner image is transferred is removed by a cleaning member 77. The removed toner is used again to form a toner image. The toner removed from the photosensitive drum 62 is stored in a waste toner chamber 71*b* of a cleaning unit 60.

<Overall Configuration of Cartridge B>

Figure 3:
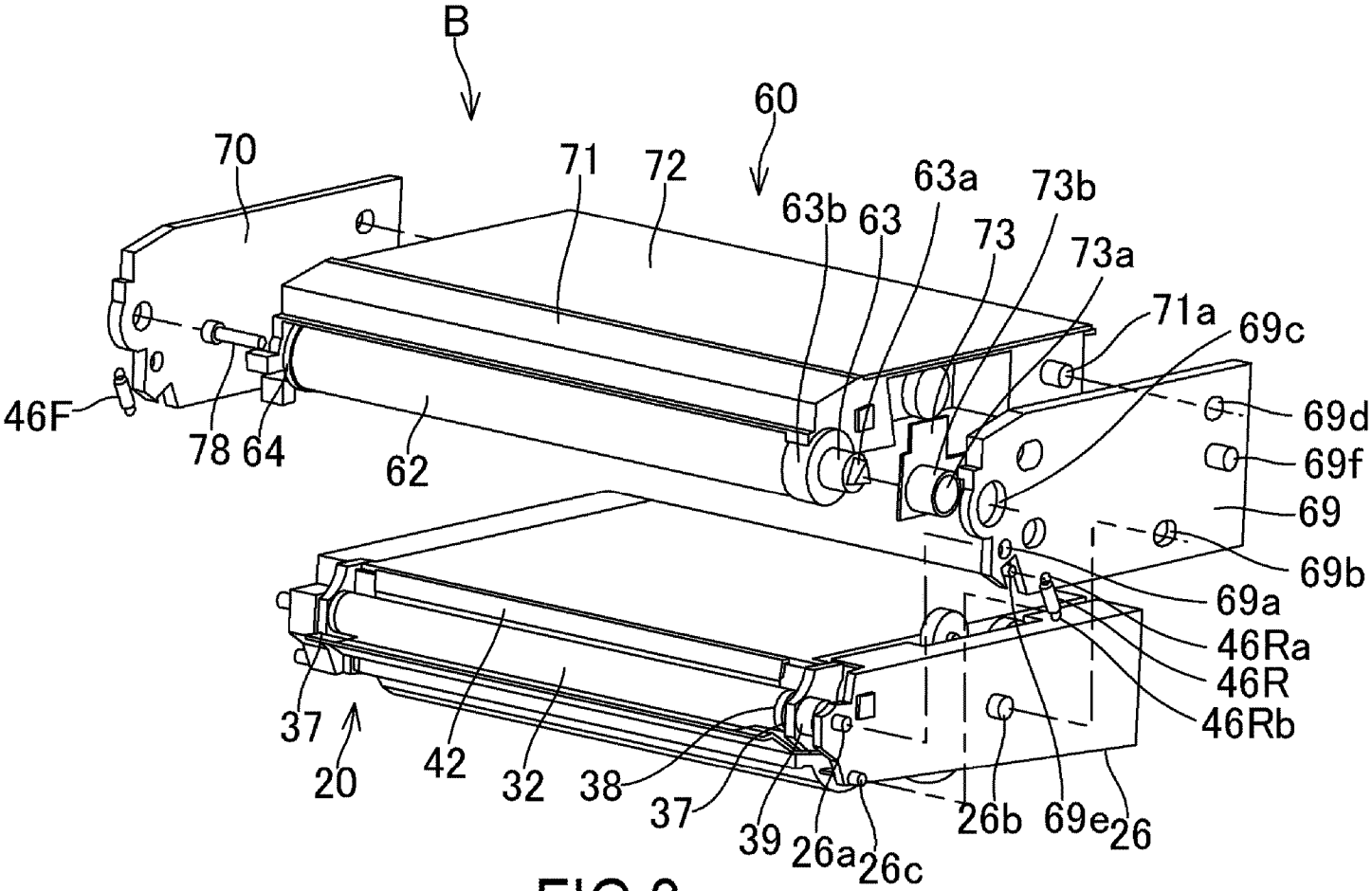
FIG. 3 is a diagram illustrating a configuration of the process cartridge according to the first embodiment.
Figure 4:
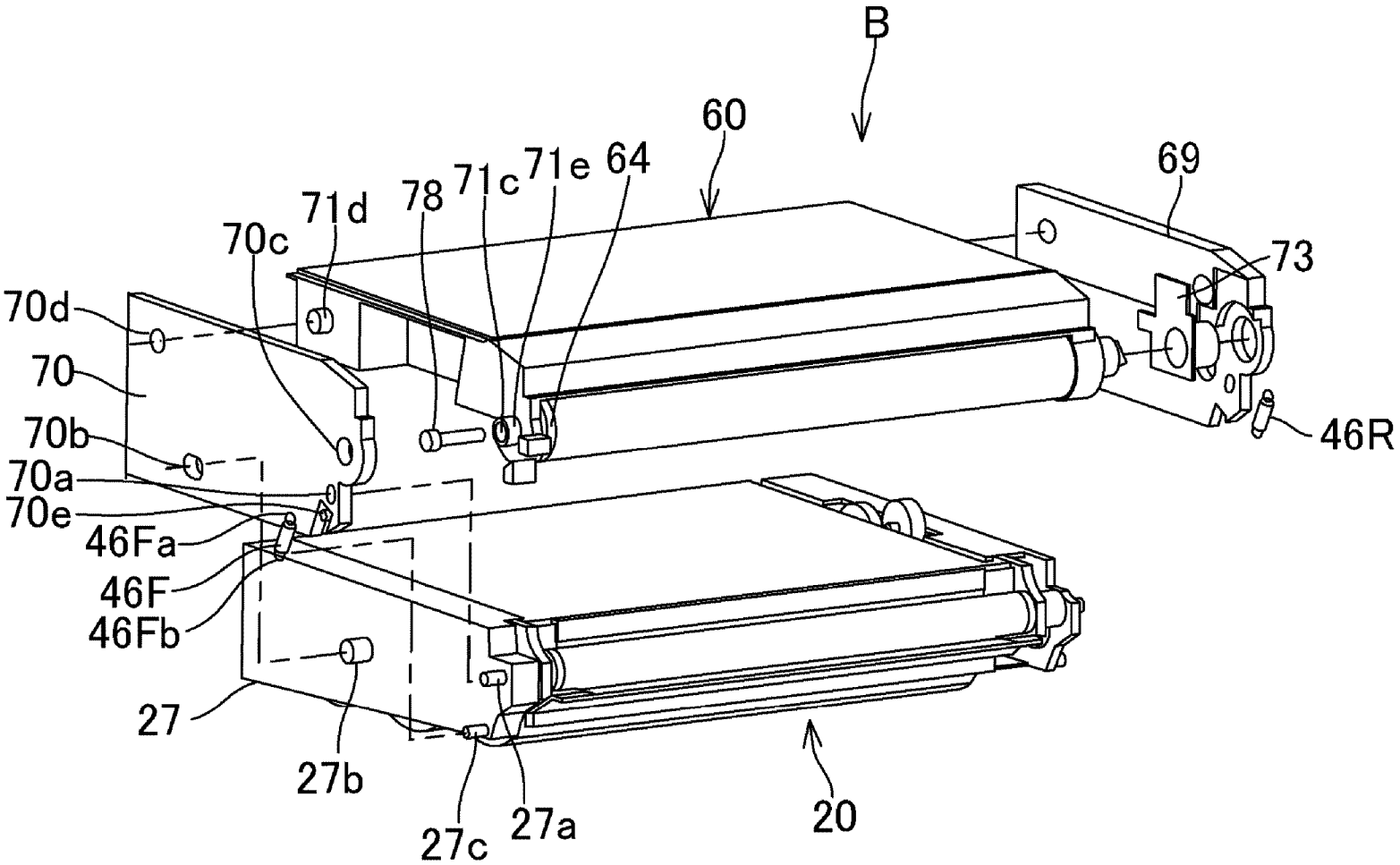
FIG. 4 is a diagram illustrating a configuration of the process cartridge according to the first embodiment.

Next, an overall configuration of the cartridge B will be described with reference to FIGS. 2 to 4. FIG. 2 is a schematic cross-sectional view of the cartridge B according to the first embodiment. FIG. 3 is a diagram illustrating a configuration of the cartridge B according to the first embodiment. FIG. 4 is a diagram illustrating a configuration of the cartridge B according to the first embodiment. In the present embodiment, description of screws for coupling respective components will not be provided.

The cartridge B according to the present embodiment will be described with reference to FIG. 2. The cartridge B includes the cleaning unit 60 and the developing unit 20. In general, a process cartridge is a cartridge in which a photosensitive drum is integrated with at least one of a charging means and a cleaning means which are process means acting on the photosensitive drum. Moreover, the process cartridge is configured to be detachably attached to an apparatus body of an image forming apparatus.

The cleaning unit 60 includes the photosensitive drum 62, the charging roller 66, the cleaning member 77, the cleaning frame 71 supporting these components, and a lid member 72 fixed to the cleaning frame 71 by welding or the like. The charging roller 66 and the cleaning member 77 are disposed so as to make contact with the outer circumferential surface of the photosensitive drum 62. The cleaning member 77 includes a rubber blade member 77*a* having a blade shape and formed of rubber which is an elastic member and a supporting member 77*b* that supports the rubber blade member 77*a*.

The rubber blade member 77*a* is in abutting contact with the photosensitive drum 62 in a counter direction relative to the rotation direction of the photosensitive drum 62. That is, the rubber blade member 77*a* is in abutting contact with the photosensitive drum 62 so that the distal end of the rubber blade member 77*a* faces the upstream side in the rotation direction of the photosensitive drum 62. The toner removed from the surface of the photosensitive drum 62 by the cleaning member 77 is conveyed to the waste toner chamber 71*b* including the cleaning frame 71 and the lid member 72 by a waste toner conveying member 54. The waste toner conveying member 54 engages with a crank member 86. When driving force is transmitted from the crank member 86 to the waste toner conveying member 54, the waste toner conveying member 54 rotates in the direction indicated by arrow Q in FIG. 2 to convey toner to the waste toner chamber 71*b*.

Moreover, a scooping sheet 65 for preventing leakage of toner from the waste toner chamber 71*b* is formed at the edge of the cleaning frame 71 so as to make abutting contact with the photosensitive drum 62. Moreover, when driving force of a body driving motor (not illustrated) which is a driving source is transmitted to the photosensitive drum 62, the photosensitive drum 62 rotates in the direction indicated by arrow R in FIG. 2 according to an image forming operation. The charging roller 66 is attached near both ends in the longitudinal direction (the direction approximately parallel to the axial direction of the center of rotation of the photosensitive drum 62) of the cleaning frame 71 so as to be rotatable with the aid of a charging roller bearing 67. A biasing member 68 presses the charging roller bearing 67 toward the photosensitive drum 62, whereby the charging roller 66 presses the photosensitive drum 62. Moreover, the charging roller 66 rotates following the rotation of the photosensitive drum 62.

The developing unit 20 includes the developing roller 32, the developing container 23 that supports the developing roller 32, the developing blade 42, and the like. The magnet roller 34 is provided inside the developing roller 32. Moreover, the developing blade 42 regulates the thickness of a toner layer borne on the developing roller 32. An interval maintaining member 38 is attached to both ends of the developing roller 32 in the axial direction of the center of rotation of the developing roller 32. The interval maintaining member 38 makes abutting contact with the photosensitive drum 62 to form a small gap between the developing roller 32 and the photosensitive drum 62.

Moreover, a blowout preventing sheet 33 for preventing toner from blowing out from the developing unit 20 is attached to the edge of a bottom member 22 so as to make abutting contact with the developing roller 32. Further, the first, second, and third conveying members 43, 44, and 50 are provided in the toner chamber 29 formed by the developing container 23 and the bottom member 22. The first, second, and third conveying members 43, 44, and 50 stir and convey the toner stored in the toner chamber 29 to the toner supply chamber 28.

As illustrated in FIGS. 3 and 4, the cartridge B is configured by coupling the cleaning unit 60 and the developing unit 20. A drum bearing 73 that rotatably supports the photosensitive drum 62, the cleaning frame 71, the lid member 72, the photosensitive drum 62, and a drum shaft 78 are provided in the cleaning unit 60. A driving-side drum flange 63 provided on the driving side is inserted into a hole 73*a* of the drum bearing 73 whereby the photosensitive drum 62 is rotatably supported. Moreover, on the non-driving side (see FIG. 4), the drum shaft 78 is press-fitted to a hole 71*c* formed in the cleaning frame 71 to rotatably support a hole (not illustrated) of a non-driving-side drum flange 64. Moreover, a flange gear portion 63*b* that transmits the driving force to a developing roller gear 39 provided on the driving side of the developing roller 32 is provided in the driving-side drum flange 63.

A driving-side drum side member 69 and a non-driving-side drum side member 70 for supporting the developing unit 20 are provided on both end sides of the cleaning frame 71. A boss 71*a* provided on the driving side of the cleaning frame 71 is inserted into a long hole 69*d* formed in the driving-side drum side member 69. Moreover, a supporting portion 73*b* of the drum bearing 73 attached to the cleaning frame 71 is inserted into a positioning hole 69*c* formed in the driving-side drum side member 69. In this way, the driving-side drum side member 69 is fixed to the cleaning frame 71.

A boss 71*d* formed on the non-driving side of the cleaning frame 71 is inserted into a long hole 70*d* formed in the non-driving-side drum side member 70. Moreover, an outer diameter portion 71*e* of a cylindrical boss in which the drum shaft 78 is inserted is inserted into a positioning hole 70*c* formed in the non-driving-side drum side member 70. In this way, the non-driving-side drum side member 70 is fixed to the cleaning frame 71.

On the other hand, the developing unit 20 includes the bottom member 22 (see FIG. 1), the developing container 23 (see FIG. 1), a driving-side developing side member 26, a non-driving-side developing side member 27, the developing roller 32, and the developing blade 42. The developing roller 32 is rotatably attached to the developing container 23 with bearing members 37 provided on both end sides of the developing roller 32 interposed. Moreover, the driving-side drum side member 69 and the non-driving-side drum side member 70 are slidably coupled whereby the developing unit 20 and the cleaning unit 60 are coupled. The cartridge B includes the developing unit 20 and the cleaning unit 60.

On one end side in the longitudinal direction of the developing unit 20, a first developing supporting portion 26*a* and a second developing supporting portion 26*b* are formed on the driving-side developing side member 26. Moreover, on the other end side in the longitudinal direction of the developing unit 20, a third developing supporting portion 27*a* and a fourth developing supporting portion 27*b* are formed on the non-driving-side developing side member 27. Moreover, the first developing supporting portion 26*a* formed on the driving-side developing side member 26 is inserted into a first long hole 69*a* formed in the driving-side drum side member 69. The second developing supporting portion 26*b* formed on the driving-side developing side member 26 is inserted into a second long hole 69*b* formed in the driving-side drum side member 69.

Moreover, the third developing supporting portion 27*a* formed on the non-driving-side developing side member 27 is inserted into a third long hole 70*a* formed in the non-driving-side drum side member 70. The fourth developing supporting portion 27*b* formed on the non-driving-side developing side member 27 is inserted into a fourth long hole 70*b* formed in the non-driving-side drum side member 70. In this manner, the driving-side drum side member 69 and the non-driving-side drum side member 70 are coupled whereby the developing unit 20 and the cleaning unit 60 are coupled.

Moreover, a first engagement portion 46Ra of a driving-side biasing member 46R is attached to a boss 69*e* of the driving-side drum side member 69. A second engagement portion 46Rb of the driving-side biasing member 46R is attached to a boss 26*c* of the driving-side developing side member 26. Moreover, a first engagement portion 46Fa of a non-driving-side biasing member 46F is attached to a boss 70*e* of the non-driving-side drum side member 70. A second engagement portion 46Fb of the non-driving-side biasing member 46F is caught at a boss 27*c* of the non-driving-side developing side member 27.

In the present embodiment, the driving-side biasing member 46R and the non-driving-side biasing member 46F are metallic tension springs and are configured to press the developing unit 20 against the cleaning unit 60 with the biasing force of the spring. Due to this, the developing roller 32 is reliably pressed toward the photosensitive drum 62. Moreover, due to the interval maintaining member 38 attached to both ends of the developing roller 32, a predetermined interval is formed between the developing roller 32 and the photosensitive drum 62.

<Cartridge Attachment and Detachment Operation>

Figure 5:
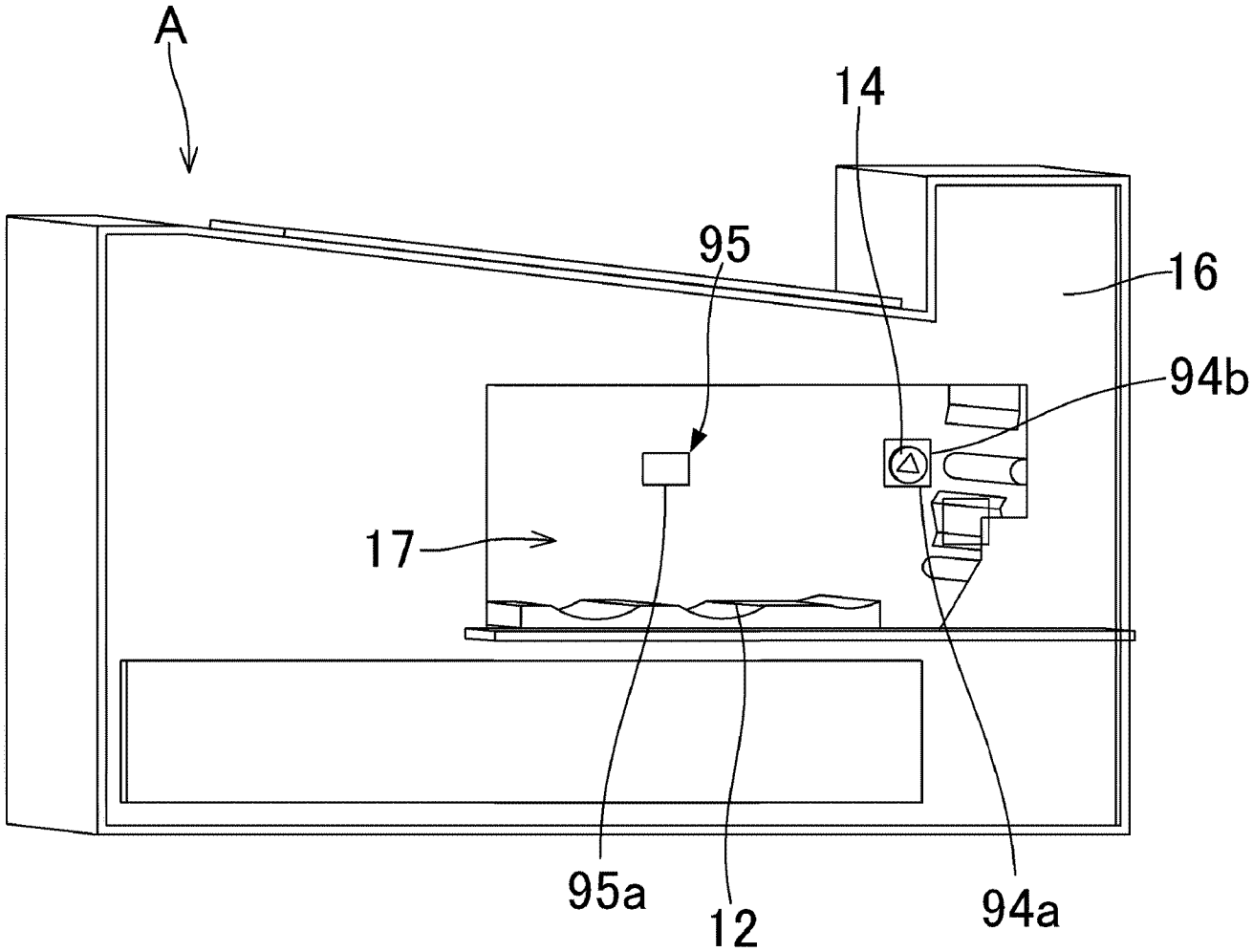
FIG. 5 is a perspective view of an apparatus body of the image forming apparatus according to the first embodiment.
Figure 6:
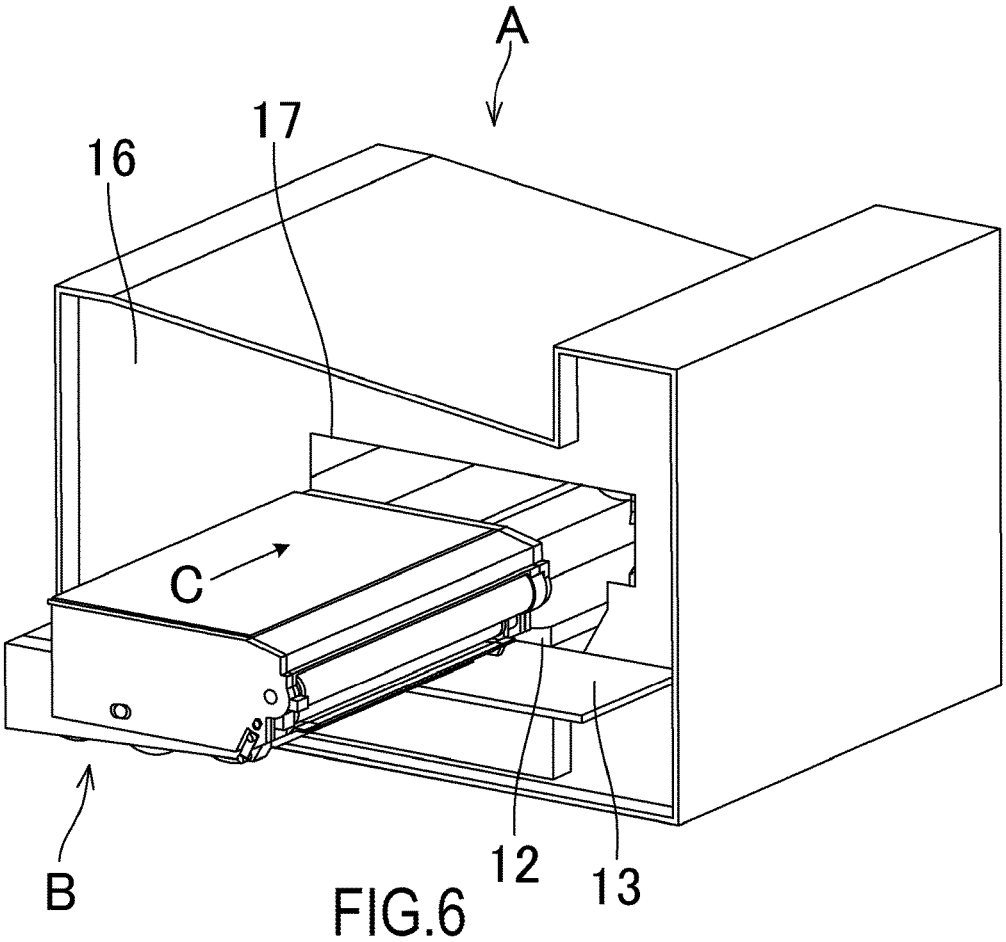
FIG. 6 is a diagram illustrating a state in which a process cartridge is to be attached to an image forming apparatus body.

FIG. 5 is a perspective view of the apparatus body A of the image forming apparatus 1 according to the first embodiment. Moreover, FIG. 6 is a diagram illustrating a state in which the cartridge B is to be attached to the apparatus body A of the image forming apparatus 1. Next, an operation of attaching and detaching the cartridge B to and from the apparatus body A of the image forming apparatus 1 will be described with reference to FIGS. 5 and 6.

An opening door 13 is pivotably attached to the apparatus body A. When a user opens the opening door 13, a cartridge attachment opening 17 formed in a non-driving sideboard 16 of the apparatus body A is exposed. Moreover, a cartridge guide 12 that guides the cartridge B into the apparatus body A is formed inside the cartridge attachment opening 17 of the apparatus body A. The cartridge B is guided to the cartridge guide 12 and inserted into the apparatus body A in the direction indicated by arrow C in FIG. 6.

Here, the direction indicated by arrow C is the axial direction of the center of rotation of the photosensitive drum 62 and the direction in which the cartridge B is inserted into the apparatus body A from the non-driving side to the driving side. That is, the non-driving side is on the upstream side and the driving side is on the downstream side in the direction in which the cartridge B is inserted into the apparatus body A. A driving shaft 14 that transmits driving force to a driving force receiver 63*a* (see FIG. 3) provided in the cartridge B is provided in the apparatus body A.

The driving shaft 14 is driven by a motor (not illustrated) provided in the apparatus body A. Due to this, the photosensitive drum 62 coupled to the driving force receiver 63*a* rotates by receiving driving force from the apparatus body A. Further, electric power is supplied to the charging roller 66 via an upstream-side charging terminal 91 (a body-side terminal) (see FIGS. 7A and 7B) formed on the apparatus body A. Moreover, electric power is supplied to the developing roller 32 via an upstream-side developing terminal 90 (a body-side terminal) (see FIGS. 7A and 7B) formed on the apparatus body A.

<Description of Electrical Terminal>

Figure 7A:
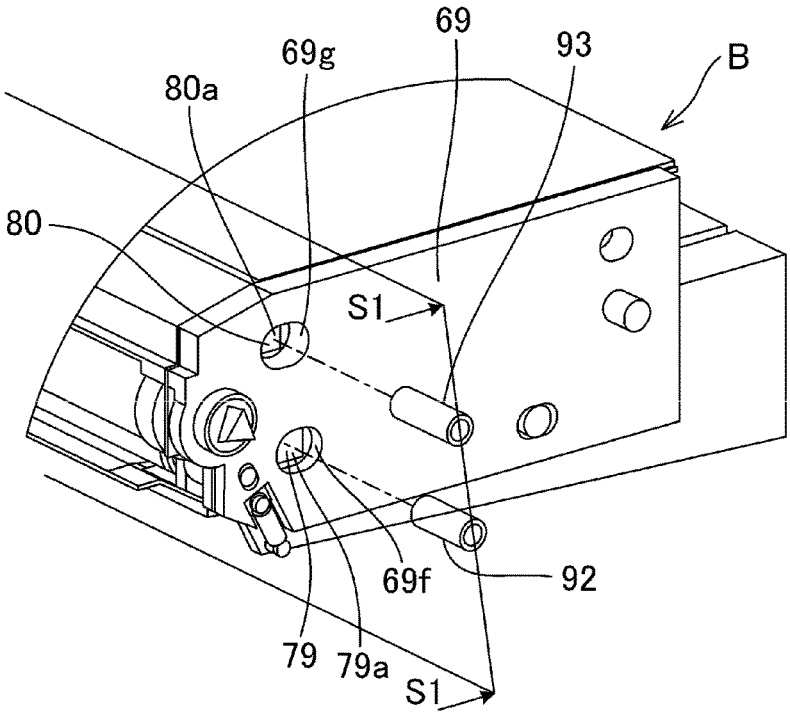
FIGS. 7A and 7B are diagrams illustrating a portion near the cartridge-side electrical terminals of the process cartridge.
Figure 7B:
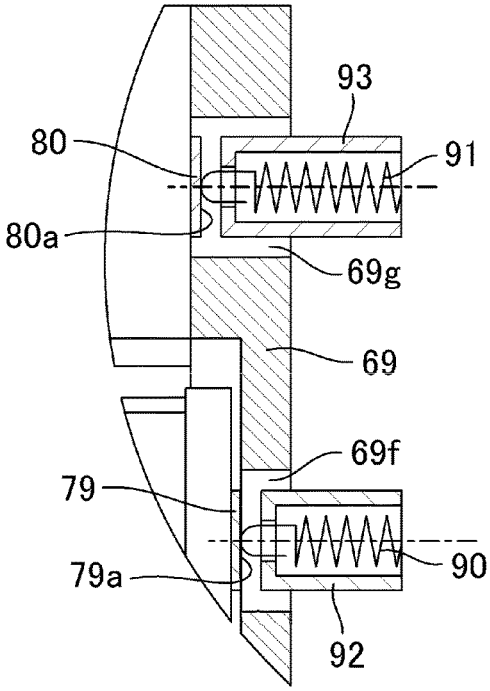
Figure 8:
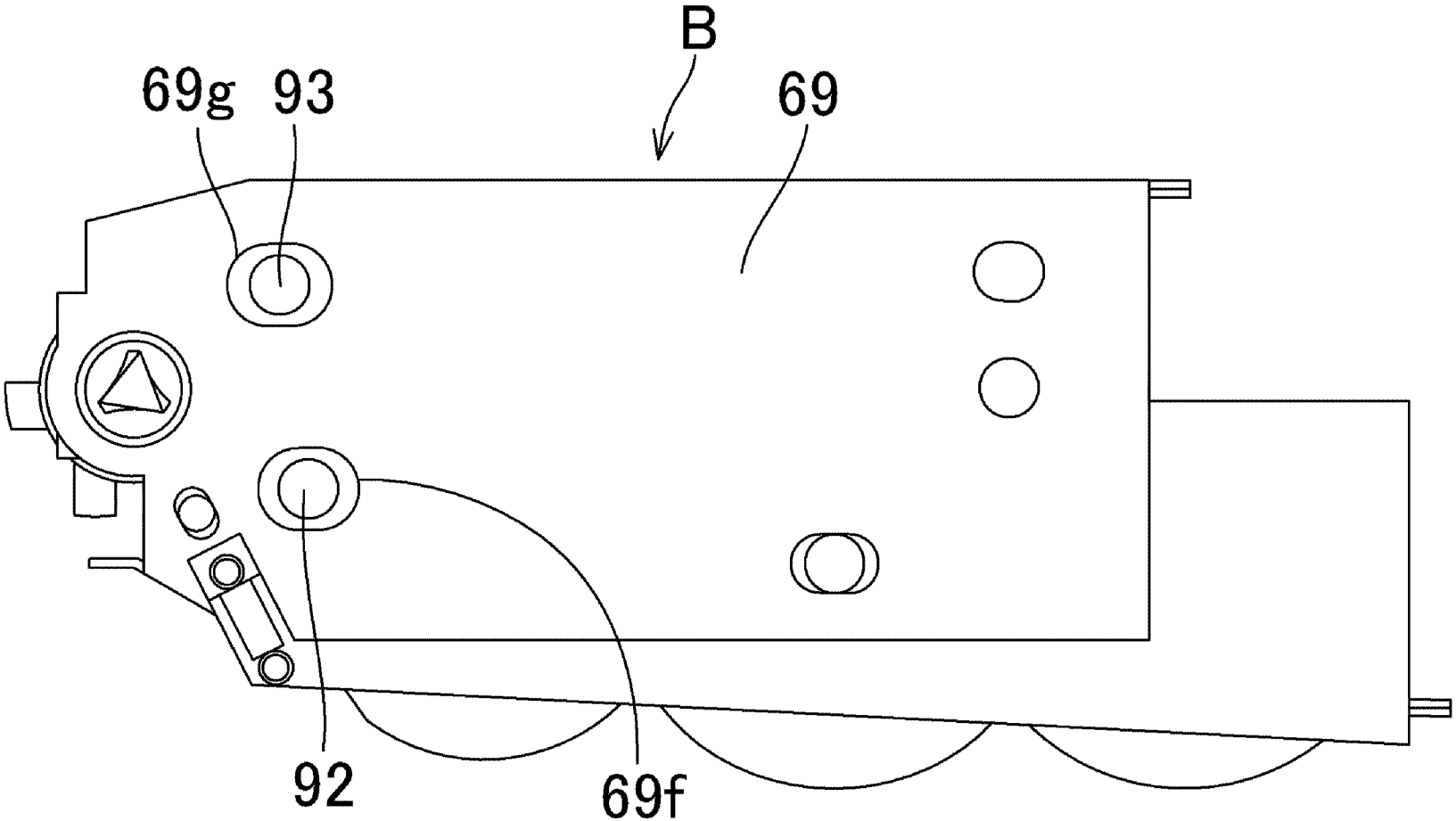
FIG. 8 is a side view of the process cartridge according to the first embodiment.

FIGS. 7A and 7B are diagrams illustrating a portion near the cartridge-side electrical terminals of the process cartridge B. FIG. 8 is a side view of the cartridge B according to the first embodiment. The configuration of the apparatus body A of the image forming apparatus 1 and the electrical terminals of the cartridge B will be described with reference to FIGS. 7A and 7B and FIG. 8. FIG. 7A is a diagram illustrating a state immediately before the cartridge B is attached to the apparatus body A. FIG. 7B is a cross-sectional view illustrating a state in which the cartridge B is attached to the apparatus body A. FIG. 7B is taken along a plane S1 in FIG. 7A.

As illustrated in FIG. 7A, a downstream-side developing terminal 79 (a first cartridge-side terminal) for supplying electricity from the apparatus body A to the developing roller 32 is formed on a side surface of the cartridge B. Electricity is supplied from the apparatus body A to the developing roller 32 via the downstream-side developing terminal 79. Moreover, a downstream-side charging terminal 80 (a second cartridge-side terminal) for supplying electricity from the apparatus body A to the charging roller 66 is formed on the side surface of the cartridge B. Electricity is supplied from the apparatus body A to the charging roller 66 via the downstream-side charging terminal 80.

Moreover, the downstream-side developing terminal 79 and the downstream-side charging terminal 80 are formed of a metal plate. The downstream-side developing terminal 79 has a connection surface 79*a* which is a surface orthogonal to the direction of attaching and detaching the cartridge B (C direction). Moreover, the downstream-side charging terminal 80 has a connection surface 80*a* which is a surface orthogonal to the direction of attaching and detaching the cartridge B (C direction). The downstream-side developing terminal 79 is electrically connected to the developing roller 32 via an electrical path (not illustrated). Moreover, the downstream-side charging terminal 80 is electrically connected to the charging roller 66 via an electrical path (not illustrated).

A hole-shaped opening 69*f* is formed in the driving-side drum side member 69 (a frame) at a position corresponding to the downstream-side developing terminal 79. Moreover, a hole-shaped opening 69*g* is formed in the driving-side drum side member 69 at a position corresponding to the downstream-side charging terminal 80. The opening 69*f* exposes the downstream-side developing terminal 79. Moreover, the opening 69*g* exposes the downstream-side charging terminal 80. Moreover, the downstream-side developing terminal 79 is disposed near an edge of the opening 69*f* on the opposite side from an edge on a side on which insertion of the upstream-side developing terminal 90 starts. That is, the downstream-side developing terminal 79 is disposed so as to be able to make contact with the upstream-side developing terminal 90 after the upstream-side developing terminal 90 passes through the opening 69*f*. Moreover, the downstream-side charging terminal 80 is disposed near an edge of the opening 69*g* on the opposite side from a side on which insertion of the upstream-side charging terminal 91 starts. That is, the downstream-side charging terminal 80 is disposed so as to be able to make contact with the upstream-side charging terminal 91 after the upstream-side charging terminal 91 passes through the opening 69*g*.

The upstream-side developing terminal 90 which is an electrical terminal formed of a spring wire or the like having elasticity is formed on the apparatus body A at the position corresponding to the downstream-side developing terminal 79. In a state in which the cartridge B is attached to the apparatus body A, the upstream-side developing terminal 90 presses the downstream-side developing terminal 79. Moreover, the upstream-side charging terminal 91 which is an electrical terminal formed of a spring wire or the like having elasticity is formed on the apparatus body A at the position corresponding to the downstream-side charging terminal 80. In a state in which the cartridge B is attached to the apparatus body A, the upstream-side charging terminal 91 presses the downstream-side charging terminal 80.

The upstream-side developing terminal 90 is supported by a developing terminal supporting member 92 which is a cylindrical supporting member formed of a resin. Moreover, the upstream-side charging terminal 91 is supported by a charging terminal supporting member 93 which is a cylindrical supporting member formed of a resin. In the process in which the cartridge B is inserted into the apparatus body A, the developing terminal supporting member 92 enters into the opening 69*f* and the charging terminal supporting member 93 enters into the opening 69*g*.

Moreover, as illustrated in FIG. 7B, when the cartridge B is completely attached to the apparatus body A, the upstream-side developing terminal 90 makes abutting contact with the connection surface 79*a* of the downstream-side developing terminal 79. Moreover, when the cartridge B is completely attached to the apparatus body A, the upstream-side charging terminal 91 makes abutting contact with the connection surface 80*a* of the downstream-side charging terminal 80. Moreover, when the upstream-side developing terminal 90 makes abutting contact with the connection surface 79*a*, the upstream-side developing terminal 90 is elastically deformed. Moreover, when the upstream-side charging terminal 91 makes abutting contact with the connection surface 80*a*, the upstream-side charging terminal 91 is elastically deformed.

Moreover, by the restoring force of the spring occurring in the upstream-side developing terminal 90, the upstream-side developing terminal 90 presses the downstream-side developing terminal 79. As a result, the downstream-side developing terminal 79 and the upstream-side developing terminal 90 are electrically connected. Moreover, by the restoring force occurring in the upstream-side charging terminal 91, the upstream-side charging terminal 91 presses the downstream-side charging terminal 80. As a result, the downstream-side charging terminal 80 and the upstream-side charging terminal 91 are electrically connected.

In the present embodiment, in a state in which the cartridge B is detached from the apparatus body A, the downstream-side developing terminal 79 is positioned on the inner side of the opening 69*f* of the driving-side drum side member 69. Thus, in the state in which the cartridge B is detached from the apparatus body A, it is less likely that a user touches the downstream-side developing terminal 79 mistakenly. Moreover, in the state in which the cartridge B is detached from the apparatus body A, the downstream-side charging terminal 80 is positioned on the inner side of the opening 69*g* of the driving-side drum side member 69. Thus, in the state in which the cartridge B is detached from the apparatus body A, it is less likely that a user touches the downstream-side charging terminal 80 mistakenly.

Moreover, in the present embodiment, in the state in which the cartridge B is detached from the apparatus body A, it is less likely that the downstream-side developing terminal 79 and the downstream-side charging terminal 80 make contact with components provided on the apparatus body A. Due to this, it is possible to reduce the risk that a foreign material adheres to the downstream-side developing terminal 79 and the downstream-side charging terminal 80. In this way, it is possible to improve the accuracy of the electrical connection between the apparatus body A and the cartridge B.

Moreover, in the present embodiment, as illustrated in FIG. 8, in the state in which the cartridge B is attached to the apparatus body A, a gap is formed between an end surface of the opening 69*f* of the cartridge B and the developing terminal supporting member 92 of the apparatus body A. That is, the developing terminal supporting member 92 does not overlap the driving-side drum side member 69, but the entire opening 69*f* is exposed. Moreover, in the state in which the cartridge B is attached to the apparatus body A, a gap is formed between an end surface of the opening 69*g* of the cartridge B and the charging terminal supporting member 93 of the apparatus body A. That is, the charging terminal supporting member 93 does not overlap the driving-side drum side member 69, but the entire opening 69*g* is exposed. This gap is set to be larger than the distance that the cartridge B can move relative to the apparatus body A in the direction orthogonal to the direction of inserting the cartridge B into the apparatus body A. Due to this, the movement of the cartridge B in relative to the apparatus body A is not restricted by the openings 69*f* and 69*g*.

As described above, in the present embodiment, the cartridge-side terminal which is an electrical terminal for supplying electricity from the apparatus body A of the image forming apparatus 1 to the cartridge B (the process cartridge) is exposed by the opening formed in the frame. Since the cartridge-side terminal is positioned in the opening, the user rarely touches the cartridge-side terminal. Due to this, a foreign material rarely adheres to the cartridge-side terminal. Thus, it is possible to maintain a satisfactory electrical connection state between the cartridge B and the apparatus body A without providing complex mechanisms.

Second Embodiment

Figure 9:
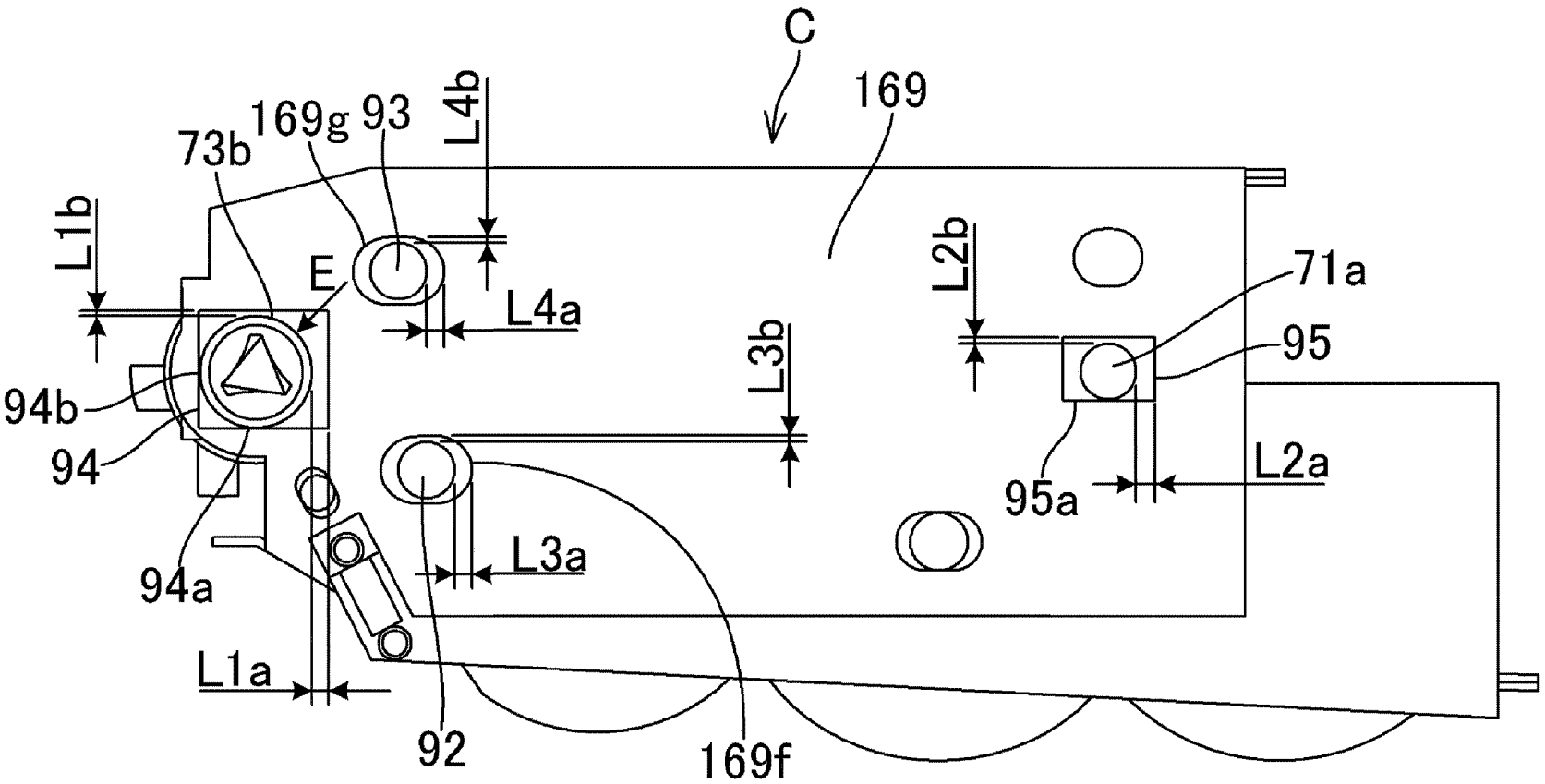
FIG. 9 is a side view of a process cartridge according to a second embodiment.

A second embodiment will be described. Here, in the second embodiment, portions having the same functions as those of the first embodiment will be denoted by the same reference numerals as used in the first embodiment and the description thereof will not be provided. FIG. 9 is a side view of a process cartridge according to the second embodiment. In the first embodiment, in the state in which the cartridge B is attached to the apparatus body A, a gap is formed between the end surface of the opening 69*f* and the developing terminal supporting member 92 and between the end surface of the opening 69*g* and the charging terminal supporting member 93. In the first embodiment, this gap is formed so that the movement of the cartridge B in relative to the apparatus body A is not restricted.

In the second embodiment, an opening 169*f* formed in a driving-side drum side member 169 has a different shape from the opening 69*f* formed in the driving-side drum side member 69 according to the first embodiment. Moreover, an opening 169*g* formed in a driving-side drum side member 169 has a different shape from the opening 69*g* formed in the driving-side drum side member 69. Thus, in the second embodiment, the gap between the opening 169*f* and the developing terminal supporting member 92 and the gap between the opening 169*g* and the charging terminal supporting member 93 are different from those of the first embodiment.

A method of positioning a cartridge C relative to the apparatus body A will be described with reference to FIG. 9. Similarly to the first embodiment, in the cartridge C the supporting portion 73*b* is provided in the drum bearing 73. Moreover, the boss 71*a* is provided on the cleaning frame 71. On the other hand, a positioning hole 94 having abutting portions 94*a* and 94*b* and a rotation stopping hole 95 having an abutting portion 95*a* are formed in the apparatus body A. Moreover, a pressing means (not illustrated) that generates pressing force E of pressing the supporting portion 73*b* is provided in the apparatus body A. By the weight of the cartridge C and the pressing force E, the supporting portion 73*b* abuts on the abutting portions 94*a* and 94*b* of the positioning hole 94. Moreover, by the weight of the cartridge C and the pressing force E, the boss 71*a* abuts on the abutting portion 95*a* of the rotation stopping hole 95.

In this state, in a horizontal direction in an attitude in which the image forming apparatus is normally used, a gap L1*a* is formed between the supporting portion 73*b* and the positioning hole 94. Moreover, in a vertical direction in an attitude in which the image forming apparatus is normally used, a gap L1*b* is formed between the supporting portion 73*b* and the positioning hole 94. Further, in the horizontal direction in an attitude in which the image forming apparatus is normally used, a gap L2*a* is formed between the boss 71*a* and the rotation stopping hole 95.

Moreover, in the vertical direction in an attitude in which the image forming apparatus is normally used, a gap L2*b* is formed between the boss 71*a* and the rotation stopping hole 95. When the image forming apparatus is shipped in a state in which the cartridge C is attached to the apparatus body A, the force exceeding the weight of the cartridge C and the pressing force E may be applied to the cartridge C during transportation. In this case, the cartridge C can move relative to the apparatus body A within the range of the gaps L1*a*, L1*b*, L2*a*, and L2*b*.

Moreover, in the horizontal direction in an attitude in which the image forming apparatus is normally used, a gap L3*a* is formed between an end surface of the opening 169*f* of the driving-side drum side member 169 and the developing terminal supporting member 92. In the vertical direction in an attitude in which the image forming apparatus is normally used, a gap L3*b* is formed between an end surface of the opening 169*f* of the driving-side drum side member 169 and the developing terminal supporting member 92. Moreover, in the horizontal direction in an attitude in which the image forming apparatus is normally used, a gap L4*a* is formed between an end surface of the opening 169*g* and the charging terminal supporting member 93. In the vertical direction in an attitude in which the image forming apparatus is normally used, a gap L4*b* is formed between an end surface of the opening 169*g* and the charging terminal supporting member 93.

Here, in the second embodiment, the gaps are in the following relation: L1*a*≅L2*a*≅L3*a*≅L4*a* and L1*b*≅L2*b*≅L3*b*≅L4*b*. That is, in a direction in which the cartridge C can move relative to the apparatus body A, the amount that the developing terminal supporting member 92 can move in the opening 169*f* is approximately the same as the amount that the cartridge C can move relative to the apparatus body A. Moreover, in the direction in which the cartridge C can move relative to the apparatus body A, the amount that the charging terminal supporting member 93 can move in the opening 169*g* is approximately the same as the amount that the cartridge C can move relative to the apparatus body A.

When the image forming apparatus is shipped in a state in which the cartridge C is attached to the apparatus body A, the force exceeding the weight of the cartridge C and the pressing force E may be applied to the cartridge C during transportation. In this case, in the second embodiment, the driving-side drum side member 169 receives the force at the four positions of the positioning hole 94, the rotation stopping hole 95, the opening 169*f*, and the opening 169*g*. In this manner, since the force received by the driving-side drum side member 169 is distributed to the four positions, it is possible to reduce the risk that the apparatus body A and the cartridge C are damaged.

As described above, the second embodiment provides the same effects as the first embodiment.

Moreover, in the second embodiment, a predetermined gap is formed between a terminal supporting member and an opening in a state in which the cartridge C (the process cartridge) is attached to the apparatus body A. Moreover, the predetermined gap is formed so that in the direction in which the cartridge C can move relative to the apparatus body A, the amount that a terminal supporting portion can move relative to the opening is approximately the same as the amount that the cartridge C can move relative to the apparatus body A. Due to this, it is possible to distribute the force that the cartridge C receives from the outside.

In the respective embodiments, the process cartridge is attached to the apparatus body of the image forming apparatus whereby an electrical terminal formed on the process cartridge is electrically connected to an electrical terminal formed on the apparatus body. However, the present invention is not necessarily limited to this. For example, a developing cartridge may be attached to the apparatus body of the image forming apparatus whereby an electrical terminal formed on the developing cartridge is electrically connected to an electrical terminal formed on the apparatus body.

Moreover, in the respective embodiments, an electrical terminal for applying a voltage to a developing roller and an electrical terminal for applying a voltage to a charging roller are disposed inside an opening formed in a frame. However, the present invention is not necessarily limited to this. For example, an electrical terminal for applying a voltage to the other electrical path such as an electrostatic capacitance-type residual toner amount detection circuit may be disposed inside an opening formed in a frame.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-132988, filed on Jul. 1, 2015, which is hereby incorporated by reference herein in its entirety.

What is claimed is:

1. An image forming apparatus comprising an apparatus body and a cartridge capable of being detachably attached to the apparatus body, wherein the apparatus body includes a body-side terminal that is a terminal for supplying electricity to the cartridge and a terminal supporting member for supporting the body-side terminal, wherein the cartridge includes:

a developing apparatus that develops as a developer image an electrostatic latent image formed on an image bearing member;

a cartridge-side terminal to which electricity is supplied from the apparatus body and which is located on a downstream side in an attaching direction of the cartridge; and a frame having an opening that exposes the cartridge-side terminal, wherein, in a process of attaching the cartridge to the apparatus body, the body-side terminal makes contact with the cartridge-side terminal so as to insert the body-side terminal and the terminal supporting member into the opening, and wherein the body-side terminal presses the cartridge-side terminal in a state in which the cartridge is attached to the apparatus body.

2. The image forming apparatus according to claim 1, wherein the opening is formed in the frame so that a gap is formed between the terminal supporting member and the opening in a state in which the cartridge is attached to the apparatus body, and wherein the gap is formed so that, in a direction which is orthogonal to the attaching direction of the cartridge and in which the cartridge can move relative to the apparatus body, an amount that the terminal supporting member can move relative to the opening is approximately the same as an amount that the cartridge can move relative to the apparatus body.

3. The image forming apparatus according to claim 1, wherein the cartridge-side terminal is disposed so as to be able to make contact with the body-side terminal after the body-side terminal passes through the opening.

4. The image forming apparatus according to claim 1, wherein the cartridge includes a developer bearing member that supplies developer to the electrostatic latent image formed on the image bearing member and a charging member that charges the image bearing member, wherein the cartridge-side terminal includes a first cartridge-side terminal for supplying electricity from the apparatus body to the developer bearing member and a second cartridge-side terminal for supplying electricity from the apparatus body to the charging member, and wherein the opening includes a first opening that exposes the first cartridge-side terminal and a second opening that exposes the second cartridge-side terminal.

5. The image forming apparatus according to claim 1, wherein the body-side terminal is a metallic spring.

6. The image forming apparatus according to claim 1, wherein the cartridge includes a first member and a second member, wherein the cartridge-side terminal includes a first cartridge-side terminal for supplying electricity from the apparatus body to the first member and a second cartridge-side terminal for supplying electricity from the apparatus body to the second member, and wherein the opening includes a first opening that exposes the first cartridge-side terminal and a second opening that exposes the second cartridge-side terminal.

7. The image forming apparatus according to claim 6, wherein the frame is attached to the developing apparatus on one end side in a longitudinal direction of the developing apparatus, and wherein the cartridge further includes an other side frame that is attached to the developing apparatus on the other end side in the longitudinal direction.

8. The image forming apparatus according to claim 7, wherein the attaching direction of the cartridge is an axial direction of the image bearing member.

9. The image forming apparatus according to claim 1, wherein the opening is formed in the frame so that a gap is formed between the terminal supporting member and the opening in a state in which the cartridge is attached to the apparatus body, and wherein the gap is set to be larger than an amount that the cartridge can move relative to the apparatus body in a direction orthogonal to the attaching direction of the cartridge.

10. A cartridge capable of being detachably attached to an apparatus body of an image forming apparatus, the cartridge comprising:

a developing apparatus that develops as a developer image an electrostatic latent image formed on an image bearing member;

a cartridge-side terminal which is a terminal for supplying electricity from the apparatus body to the cartridge and which is located on a downstream side in an attaching direction of the cartridge; and a frame having an opening that exposes the cartridge-side terminal and into which a body-side terminal, provided on the apparatus, and a terminal supporting member, supporting the body-side terminal body, are inserted when the cartridge is attached to the apparatus body.

11. The cartridge according to claim 10, wherein the cartridge-side terminal is disposed so as to be able to make contact with the body-side terminal after the body-side terminal passes through the opening.

12. The cartridge according to claim 10, wherein the cartridge includes a first member and a second member, wherein the cartridge-side terminal includes a first cartridge-side terminal for supplying electricity from the apparatus body to the first member and a second cartridge-side terminal for supplying electricity from the apparatus body to the second member, and wherein the opening includes a first opening that exposes the first cartridge-side terminal and a second opening that exposes the second cartridge-side terminal.

13. The cartridge according to claim 12, wherein the frame is attached to the developing apparatus on one end side in a longitudinal direction of the developing apparatus, and wherein the cartridge further includes an other side frame that is attached to the developing apparatus on the other end side in the longitudinal direction.

14. The cartridge according to claim 13, wherein the attaching direction of the cartridge is an axial direction of the image bearing member.

15. The cartridge according to claim 10, wherein the opening is formed in the frame so that a gap is formed between the terminal supporting member and the opening in a state in which the cartridge is attached to the apparatus body, and wherein the gap is set to be larger than an amount that the cartridge can move relative to the apparatus body in a direction orthogonal to the attaching direction of the cartridge.

* * * * *